United States Patent [19]

Genberg

[11] 4,026,232

[45] May 31, 1977

[54] APPARATUS FOR STOWING AN ANCHOR

[75] Inventor: Hans-Arvid Genberg, Torslanda, Sweden

[73] Assignee: AB Gotaverken Company, Goteborg, Sweden

[22] Filed: Feb. 17, 1976

[21] Appl. No.: 658,268

[52] U.S. Cl. ..... 114/210; 114/179

[51] Int. Cl.[2] ..... B63B 21/22

[58] Field of Search ..... 114/210, 206 R, 182, 114/179

[56] References Cited

UNITED STATES PATENTS

| | | | |
|---|---|---|---|
| 253,112 | 1/1882 | Scott et al. | 114/210 |
| 323,774 | 8/1885 | Baxter | 114/179 |
| 1,739,359 | 12/1929 | Hausenfluck | 114/210 |
| 3,082,730 | 3/1963 | Good | 114/210 |

*Primary Examiner*—Trygve M. Blix
*Assistant Examiner*—Gregory W. O'Connor
*Attorney, Agent, or Firm*—Schovee & Boston

[57] ABSTRACT

The conventional anchor stowing arrangement on a ship includes a hawser pipe through which the anchor chain passes, and in which the leg of the anchor is normally located during a voyage. According to the present arrangement the anchor is stowed upon an open bed, easy to reach for inspection from the deck, and not likely to cause any damages during hauling-in.

3 Claims, 2 Drawing Figures

APPARATUS FOR STOWING AN ANCHOR

BACKGROUND OF THE INVENTION

In ships of conventional design the anchor chain passses through a hawser pipe, extending obliquely downwards from the ship's deck, through a space within the hull to an opening in the side plating. When the anchor is hauled-in its leg will extend into the hawser pipe, while the crown with its arm are located outside the side plating, where they are difficult to reach, and also will cause damage, especially during hauling-in.

SUMMARY OF THE INVENTION

The invention refers to novel means for receiving and stowing a so-called patent anchor, having a leg and a crown with arms pivotably connected thereto, upon an open bed arranged on a ship's deck, and is characterized in that the bed inside the side plating of the ship includes an inclined portion raising above the deck and adapted to receive the leg of the anchor, this raised portion being located inside of an outwardly open pocket, recessed below the deck and being downwardly defined by a surface of sufficient size to receive the crown of the anchor, substantially inside of the contour line of the side plating.

This novel arrangement has a number of advantages. The stowed anchor will not be subjected to the same action by the waves as in previous designs as it will be located higher above sea level and will be received inside of the contour of the side plating.

The anchor is furthermore easily accessible for locking, inspection and cleaning.

The arrangement also makes the installation more easy, which means that less fitting will have to be done during the busy days before delivery. A "stopper bed" may be mounted simultaneously with, or even before the windlass. There is no need to cut holes in the side plating for the hawser pipe and the doublings around the latter may be dispensed with. The maintenance and upkeep of the ship will be reduced as no damages to the hull around the mouths of the hawser pipes will occur, and as the anchor will be dropped from a higher point, and more outside of the side plating proper, damage to the paint coating will be reduced.

The location of the anchor is also more favourable from a safety point of view as it will be easier to arrange for secure locking, and it will also be possible to inspect and locate damage to the anchor.

DESCRIPTION OF A PREFERRED ARRANGEMENT

Figure 1:
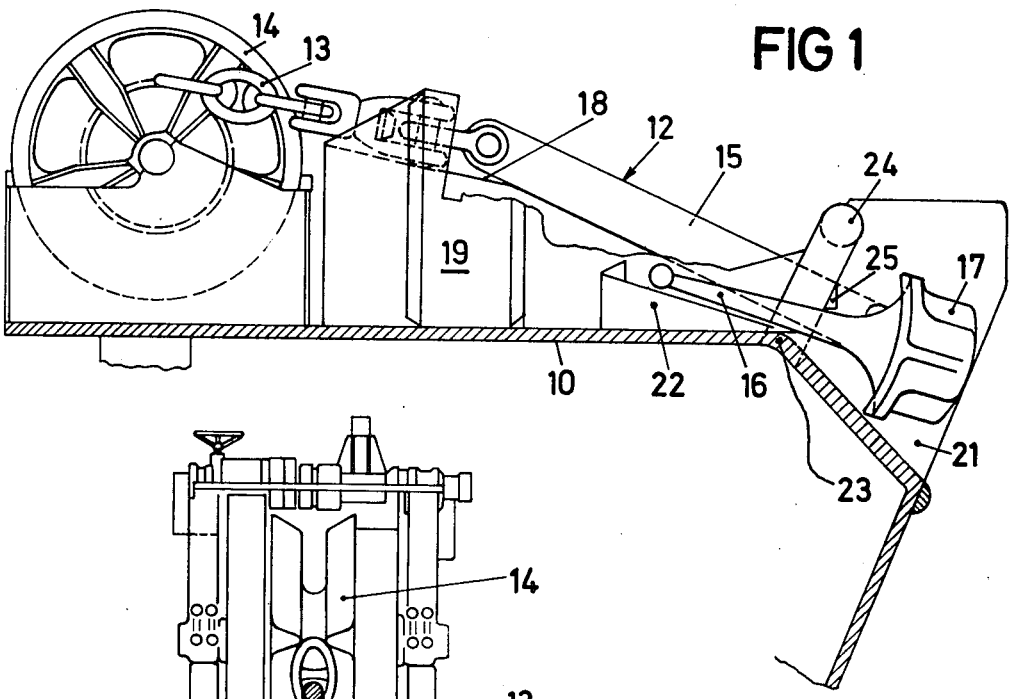
FIG. 1 is a cross-section of a portion of a ship's deck at the position of an anchor bed.
Figure 2:
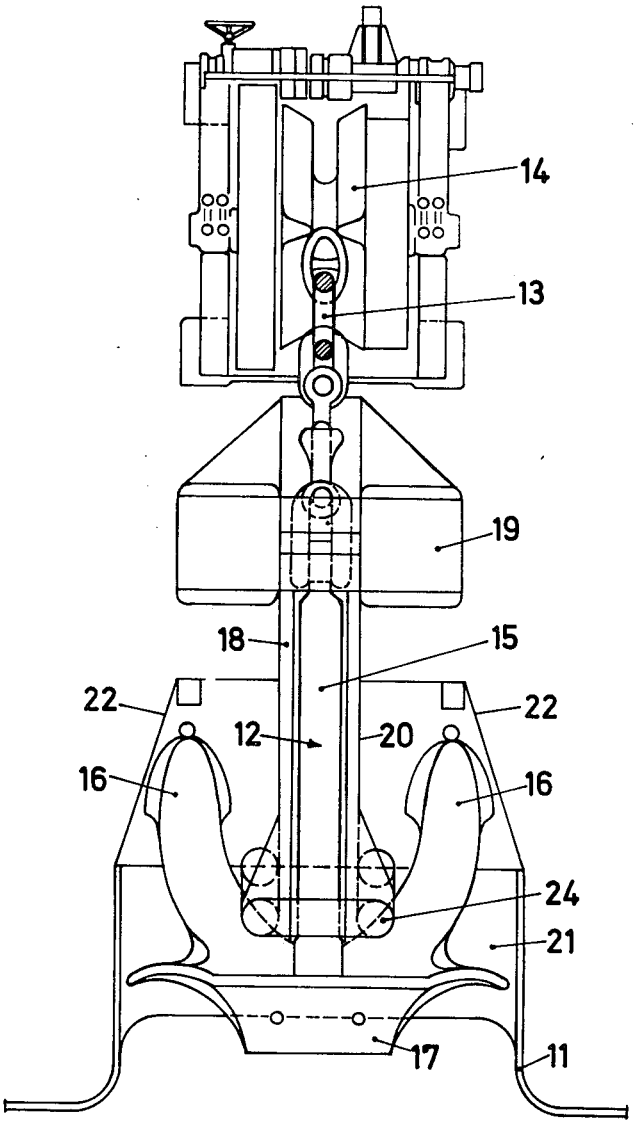
FIG. 2 shows the anchor bed and the windlass, as viewed from above.

In FIGS. 1 and 2 the deck of a ship is denoted by 10 and the side plating by 11. The anchors are conventionally located in the fore part of the ship and here the upper areas of the side plating are markedly flared outwards. The higher up the anchor can be located, the further away from the side plating proper the anchor and the chain will pass when the anchor is dropped.

The anchor 12 is, in the drawing, shown in its stowed position and is attached to a chain 13, which, in the usual manner, is handled by a windlass 14.

The anchor 12 is of so called patent type and includes a leg 15 and a crown 17 having arms 16, the crown being pivotably connected to the leg.

The anchor is stowed upon a bed 18, which is open upwards and is adapted to receive the leg of the anchor. This bed is located above the deck 10 of the ship, having such an inclination that the anchor will slide downwards automatically, when a retaining force is released.

This retaining force is in the first place provided by the windlass 14, but in addition to that there is a locking arrangement, generally denoted by 19 and including levers or similar means adapted to engage and to lock against a link of the chain or the shackle connecting the chain to the leg.

Side supports 20 extend upwards along both sides of the bed 18 enclosing leg 15. At the bottom of the bed 18 a pocket 21 is recessed into the deck, being open outwards and generally adapted to receive the crown 17 of the anchor and the base portions of arms 16, so these parts, when the anchor is fully hauled-in, will be located inside of the contour line of the side plating 11 of the ship. The pocket 21 will form a hawser guiding the anchor so the chain will obtain the proper direction with respect to the locking arrangement 19 and the windlass.

The bills or end portions of the arms 16 will rest upon inclined supports 22 at the deck inside the pocket 21, the bottom surface of which is inclined downwards away from the bed.

At the transition between pocket 21 and the deck 10, a stopper 24 formed as a reversed U-shaped staple. This is adapted to straddle the bed and an anchor's leg 15 resting thereon. The side members of the staple are formed in such a manner that the arms of the anchor may be hauled-up, outside the staple and also the bed 18. Each side member is provided with a shoulder 25 located at such height above the knuckle 23 between the deck and the pocket, that the associated portion of the arm will be wedged between the shoulder and the knuckle.

What we claim is:

1. Means for receiving and stowing an anchor, having a leg and a crown with arms pivotably connected thereto, on a ship defined by side plating and a deck, comprising:

a. an outwardly open pocket, recessed below said deck and being downwardly defined by a surface of sufficient size to receive the crown of said anchor, substantially inside of the contour line of said side plating, b. an open bed arranged on said deck, inside said pocket and including an inclined portion raising above said deck and adapted to receive the leg of said anchor, and c. stopper means, including a pair of spaced-apart, upwardly extending stopper legs, fitted between the raised portion of said bed and said pocket for straddling the bed and the leg of an anchor resting thereon while permitting the arms of the anchor to be moved inwards outside of the stopper means.

2. The means according to claim 1, in which each of said stopper legs is provided with a shoulder on its outward side located at a distance above said bed, corresponding to the thickness of that portion of an arm of said anchor being located opposite to the stopper means, when said anchor is in stowed position.

3. The means according to claim 1 wherein said stopper means has the shape of an upside-down U.

* * * * *